US005694667A

United States Patent [19]

Mizuno

[11] Patent Number: 5,694,667

[45] Date of Patent: Dec. 9, 1997

[54] AUTOMATIC LOCK SLIDER FOR SLIDE FASTENER

[75] Inventor: Hiroshi Mizuno, Toyama-ken, Japan

[73] Assignee: YKK Corporation, Tokyo, Japan

[21] Appl. No.: 655,674

[22] Filed: May 30, 1996

[30] Foreign Application Priority Data

May 31, 1995 [JP] Japan ..... 7-133094

[51] Int. Cl.[6] ..... A44B 19/30

[52] U.S. Cl. ..... 24/421

[58] Field of Search ..... 24/420, 421, 422, 24/424

[56] References Cited

U.S. PATENT DOCUMENTS

| | | | |
|---|---|---|---|
| 2,373,523 | 4/1945 | Winterhalter | 24/421 |
| 4,048,699 | 9/1977 | Kanzaka | 24/421 |
| 4,976,014 | 12/1990 | Akashi et al. | 24/421 |

FOREIGN PATENT DOCUMENTS

| | | | |
|---|---|---|---|
| 678 131 | 9/1966 | Belgium . | |
| 2 058 028 | 5/1971 | France . | |
| 424343 | 5/1967 | Switzerland | 24/420 |
| 2 180 593 | 4/1987 | United Kingdom . | |

*Primary Examiner*—James R. Brittain

*Attorney, Agent, or Firm*—Hill, Steadman & Simpson

[57] ABSTRACT

In an automatic lock slide fastener slider, a slider body has on the upper surface of an upper wing a pull-tab attaching lug at is front end, an auxiliary lug at its rear end, and a guide projection between the attaching lug and a locking-pawl-insertion though-hole. The attaching lug has a central groove, a pair of transverse recesses and opposite side recesses. The auxiliary lug has a vertical groove and opposite side recesses. The guide projection has a central cutout contiguous to the through-hole. A locking leaf spring has at one end a resilient portion to be received in the central groove and the other end a locking pawl to be inserted in the though-hole. With a pintle of a pull tab between the attaching lug and the guide projection, a cover is mounted over the two lugs so as to hold the resilient-portion-side end of the leaf spring.

24 Claims, 4 Drawing Sheets

AUTOMATIC LOCK SLIDER FOR SLIDE FASTENER

BACKGROUND OF THE INVENTION

1. Field of the Invention

This invention relates generally to a slider for a slide fastener, and more particularly to an automatic lock slider in which a leaf spring has at one end a locking pawl and at the other end a U-shaped resilient portion.

2. Description of the Related Art

FIG. 7 of the accompanying drawings shows a conventional automatic lock slide fastener slider in which an upper wing 5' of a slider body 1' has on its upper surface front and rear (right and left in FIG. 7) lugs 10', 11', the front lug 10' having in its upper surface a central groove 12'. A locking leaf spring 2' has at one end a locking pawl 26' projecting into a fastener element guide channel 9' from a locking-pawl-insertion through-hole 22' of the upper wing 5', and at the other end a U-shaped resilient portion 27' received in the central groove 12' of the front lug 10', there being a trapezoidal actuation 29' portion extending between the locking pawl 26' and the resilient portion 27'. With a pintle 35' of a pull tab placed between the actuation portion 29' and the upper wing 5', the leaf spring 2' is concealed by a cover 3', which is clenched against the front and rear lug 10', 11'. This conventional art is exemplified by Japanese Utility Model Laid-Open Publication No. Hei 6-86539.

With the known automatic lock slider as mentioned above, partly since part of the resilient portion 27' is merely received in the central groove 12' of the front lug 10' in order to stablize the locking leaf spring 2' and partly since the end of the resilient portion 27' is merely pressed by the cover 3', stable mounting of the locking leaf spring 2' on the slider body 1' cannot be achieved.

Further, in order to reduce the size of the slider, the front lug 10' on the upper wing 5' also should necessarily be smaller, in which case the side walls of the front lug 10' would be apt to fall flat inwardly when the cover 3' is clenched against the side walls after the resilient portion 27' of the locking leaf spring 2' is received in the central groove 12' of the front lug 10', thus pressing the resilient portion 27' to deteriorating its resiliency. In the conventional art, it has consequently been difficult to realize a small-size automatic lock slide fastener slider.

Furthermore, in automatic assembling process of the conventional sliders, since the individual covers 3' has an asymmetrical shape, it is inevitable to line up the successive covers 3' in one way during supplying, thus making the cover supplying mechanism of an automatic assembling machine complex so that only a limited rate of production can be achieved.

SUMMARY OF THE INVENTION

It is therefore an object of this invention to provide an automatic lock slider, for a slide fastener, in which a locking leaf spring is mounted on a slider body in a stable posture and has a good durability without deteriorating its resilience even if the slider is small in size, facilitating supplying successive covers during automatic assembling and hence guaranteeing an improved rate of production.

In order to accomplish the above object, according to this invention, there is provided an automatic lock slider for a slide fastener, comprising: a slider body composed of upper and lower wings joined together at their front ends by a guide post so as to define between the upper and lower wings a fastener-element guide channel, the upper wing having a through-hole communicating with the fastener-element guide channel; a pull-tab attaching lug projecting on an upper surface of the upper wing and having a central groove; an S-shape leaf spring having at one end a resilient portion received in the central groove and at the other end a locking pawl urged to normally project into the fastener-element guide channel through the through-hole under the resilience of the leaf spring, the leaf spring further having an actuation portion extending between the resilient portion and the locking pawl; a pull tab having a pintle placed between the actuation portion of the leaf spring and the upper wing for actuating the actuation portion to retract the locking pawl from the fastener-element guide channel; and a cover secured to the pull-tab attaching lug for covering the leaf spring, the cover having on its inner surface a spring-holding projection fitted in the central groove of the pull-tab attaching lug so as to hold the one end of the leaf spring in the central groove.

Preferably, the automatic lock slider of the invention further comprises an auxiliary lug projecting on the upper surface of the upper wing at a rear end, the pull-tab attaching lug being situated at a front end of the upper wing, each of the lugs having a pair of opposite side recesses each defining a straight stepped portion, the cover having opposite side walls clenched against the opposite side recesses. Further, the attaching lug has in its upper surface a pair of transverse recesses, and the leaf spring has at the one end a pair of opposite side protuberances received in the transverse recesses and held by the cover.

Furthermore, the auxiliary lug has in its rear end surface a vertical groove, and the cover has on each of its front and rear inner wall surfaces a vertical ledge fitted in the central groove of the pull-tab attaching lug and the vertical groove of the auxiliary lug, respectively.

Still furthermore, the automatic lock slider of this invention may comprise a guide projection standing from the upper surface of the upper wing between the pull-tab attaching lug and the through-hole and having on its front end an inclined guide surface. The pull-tab attaching lug having on its rear end an inclined guide surface confronting the guide surface of the guide projection, and the guide projection has an upper central cutout for receiving the actuation portion of the leaf spring, with the pintle of the pull tab located between the two guide surfaces.

In the automatic lock slider of this invention, the cover has centrally in its opposite side walls a pair of pivot holes through which the pintle of the pull tab is inserted, the cover further having another spring-holding projection, so as that the vertical ledges and spring-holding projections being arranged in symmetry longitudinally of the cover.

In the slider, if the pull tab is pulled in either direction, the pintle of the pull tab is guided by the confronting guide surfaces of the attaching lug and the guide projection to raise the actuation portion of the leaf spring against the resiliency of the resilient portion 27 until it comes into contact with the slope of the spring-holding projection of the cover. As a result, the locking pawl is retracted from the guide channel so that the slider can be slid freely in either direction.

If the pull tab is released, the actuation portion is moved toward the upper wing of the slider body under the resilience of the resilient portion to bring the pintle along the guide surfaces, thus causing the locking pawl to project into the guide channel for engagement with the fastener element rows to stop the slider.

In the slider of another embodiment of this invention, if the pull tab is pulled, the trapezoidal actuation portion of the locking leaf spring is raised against the resilience of the resilient portion to retract the locking pawl from the guide channel so that the slider can be slid freely in either direction. If the pull tab is released, the actuation portion is moved toward the upper wing of the slider body under the resilience of the resilient portion to cause the locking pawl to project into the guide channel for engagement with the fastener element rows to stop the slider.

DETAILED DESCRIPTION OF THE PREFERRED EMBODIMENTS

Figure 1:
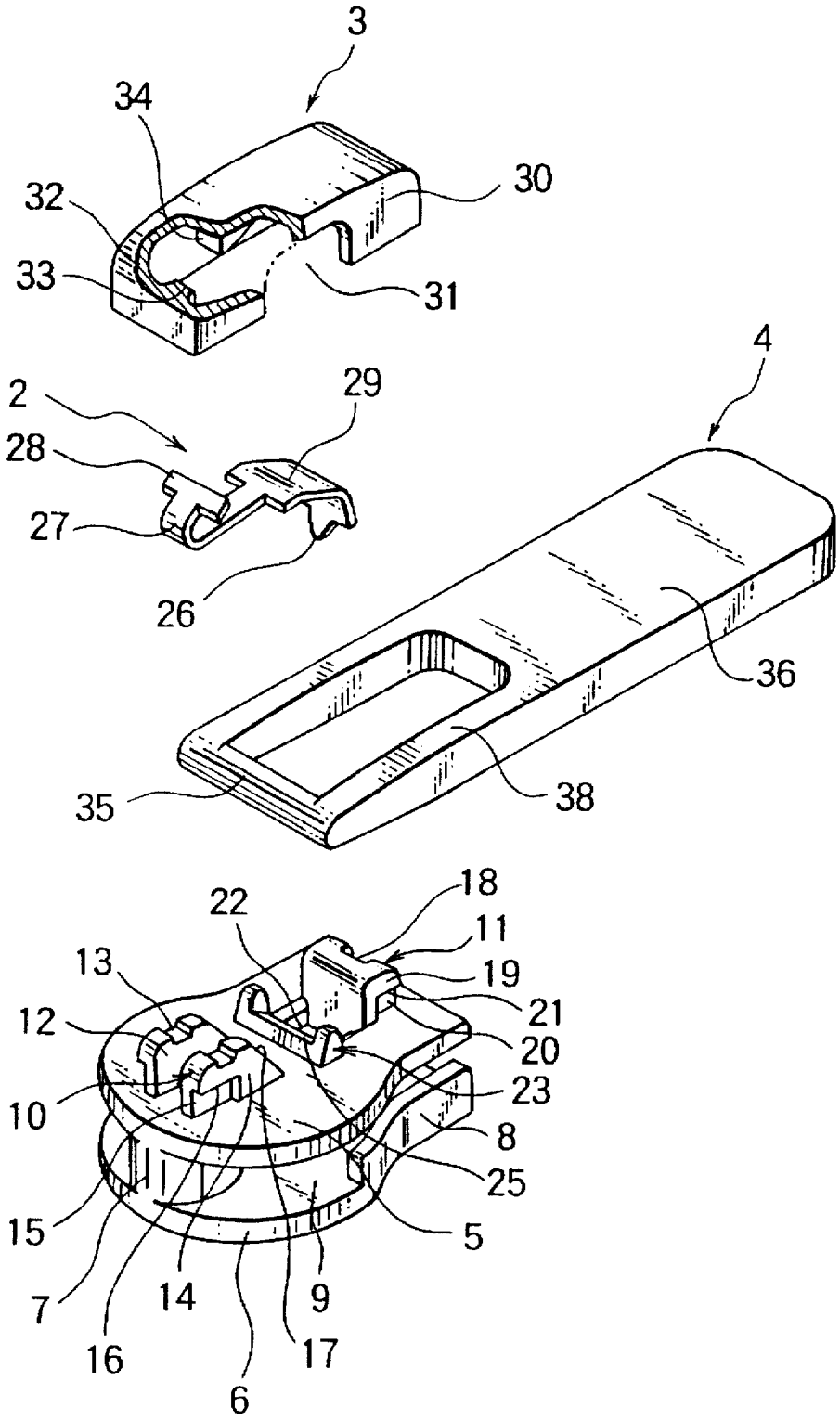
FIG. 1 is an exploded perspective view of an automatic lock slider, for a slide fastener, according to a first embodiment of this invention.
Figure 2:
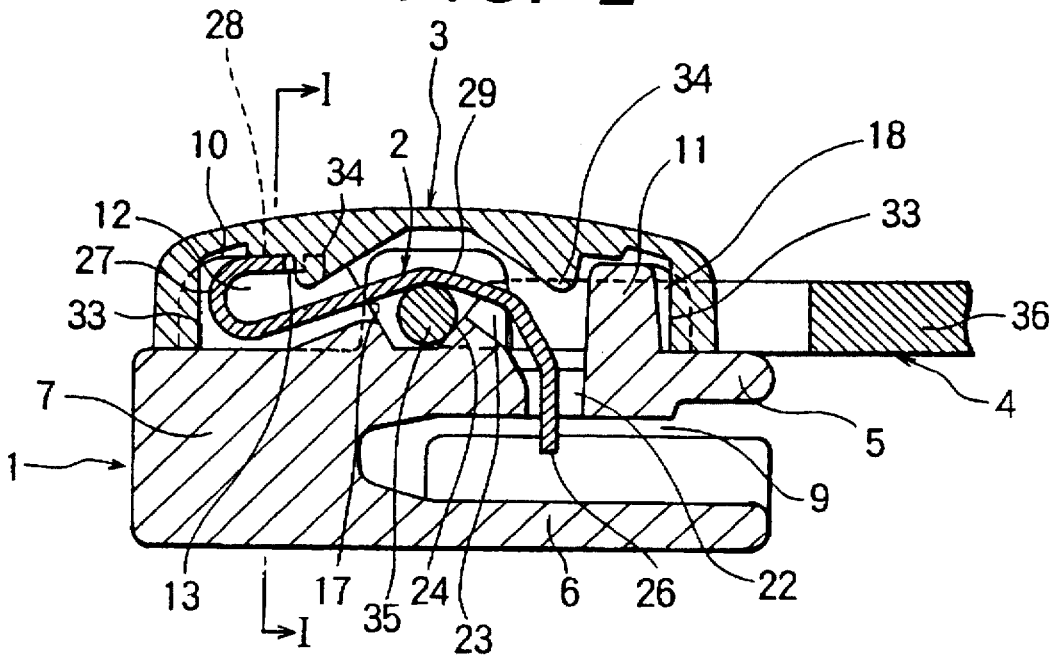
FIG. 2 is a longitudinal cross-sectional view of the slider of the first embodiment, showing the slider as locked.
Figure 3:
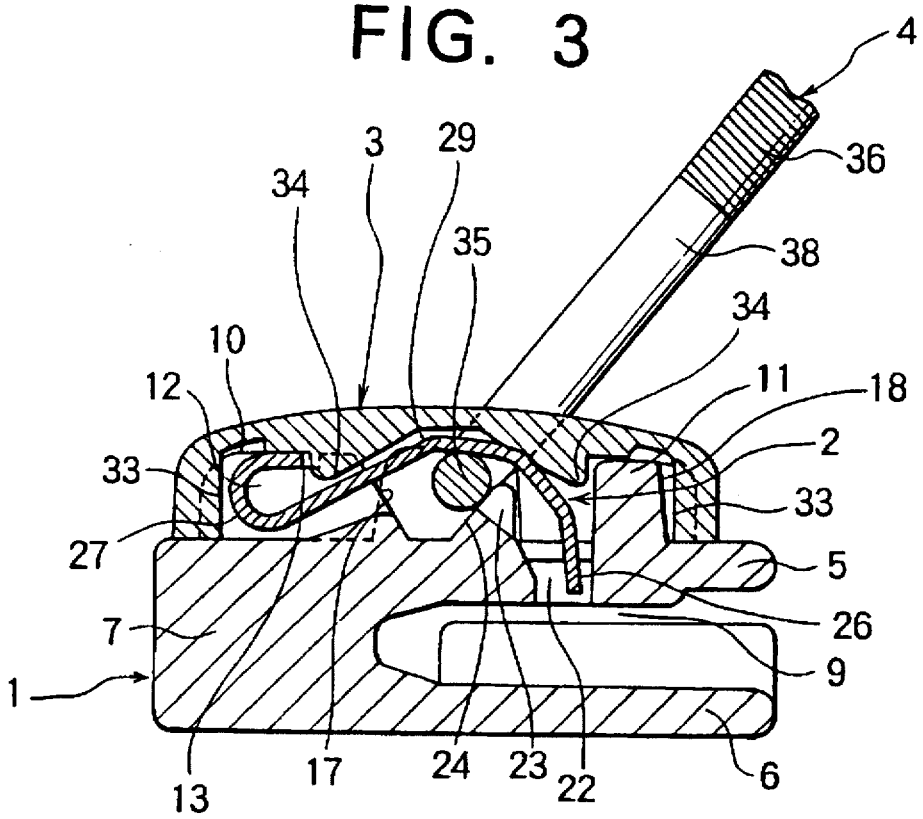
FIG. 3 is a longitudinal cross-sectional view similar to FIG. 2, but showing the slider as unlocked.
Figure 4:
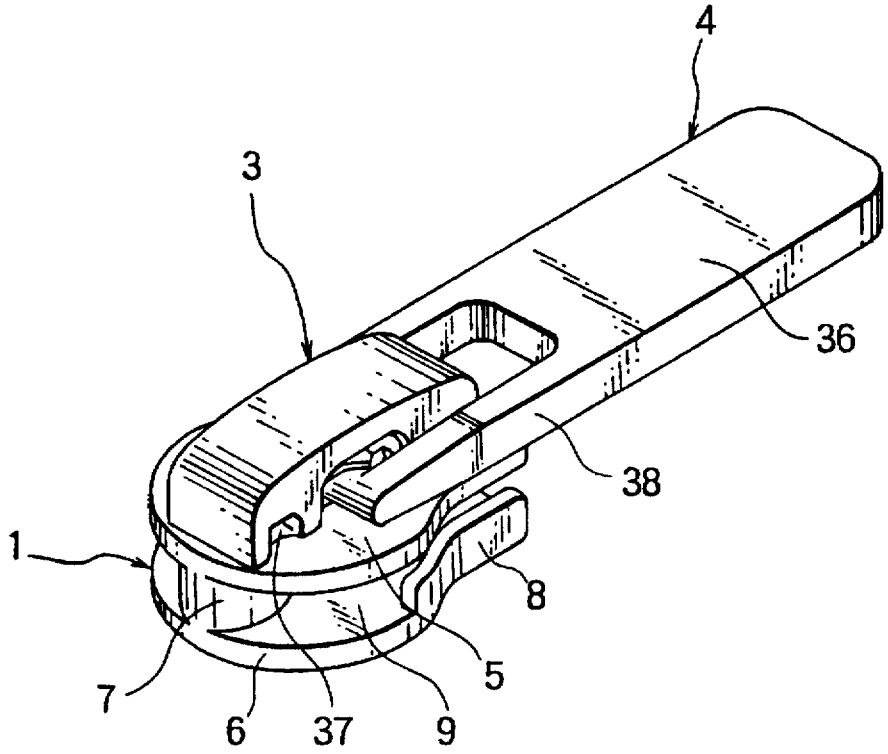
FIG. 4 is a perspective view of the slider of the first embodiment, showing the slider as assembled.

Preferred embodiments of the automatic lock slider according to this invention will now be described in detail with reference to the accompanying drawings. Like reference numerals designate similar or equivalent parts or elements throughout the different embodiments.

FIGS. 1 through 5 show an automatic lock slider, for a slide fastener, according to a first embodiment of this invention. This slider is a four-member slider comprising a slider body 1, a locking leaf spring 2, a cover 3 and a pull tab 4. The slider body 1 is composed of upper and lower wings 5, 6 joined together by a guide post 7 so as to define between the upper and lower wings 5, 6 a fastener-element guide channel 9, the lower wing 6 having along its opposite side edges a pair of guide flanges 8.

The slider body 1 has on the upper surface of the upper wing 5 a pull-tab attaching lug 10 at its front end and an auxiliary lug 11 at its rear end. The attaching lug 10 has a central groove 12 longitudinally extending to the upper surface of the upper wing 5 and also in its upper surface a pair of transverse recesses 13, 13 extending perpendicularly to the central groove 12. Further, the attaching lug 10 has a pair of square-shape recesses 15 one in a front base portion of each of opposite side walls 14, the upper part of each recess 15 being defined by a straight stepped portion 16. Furthermore, the attaching lug 10 has on its rear surface an inclined guide surface 17.

The auxiliary lug 11 has on its rear end surface a vertical groove 18 having a width equal to that of the central groove 12 of the attaching lug 10 and extending to the upper surface of the upper wing 5. The auxiliary lug 11 has also a pair of square-shape recesses 20 one in a rear base portion of each of opposite side walls 19, the upper part of each recess 20 being defined by a straight stepped portion 21. The upper wing 5 has at a position contiguous to the front side of the auxiliary lug 11 a locking-pawl-insertion through-hole 22 communicating with the guide channel 9.

In addition, the upper wing 5 has on its upper surface at a position between the through-hole 22 and the attaching lug 10 a guide projection 23 having an inclined guide surface 24 confronting the guide surface 17 of the attaching lug 10. The guide projection 23 has centrally in its upper part a cutout 25 whose bottom surface slightly slopes toward the through-hole 22.

The locking leaf spring 2 has a generally S-shape profile having at one end a locking pawl 26 and at the other end a U-shape resilient portion 27. The resilient portion 27 has a width so as to be received in the central groove 12 of the attaching lug 10 and has at its end a pair of opposite side protuberances 28, 28 to be received in the transverse recesses 13, 13 of the attaching lug 10. In addition, the locking leaf spring 2 has between the resilient portion 27 and the locking pawl 26 a large-width actuation portion 29 so as to be received in the cutout 25 of the guide projection 23. The upper end portion of the U-shape resilient portion 27 is shorter than the lower end portion thereof.

The cover 3 has in centrally each of opposite side walls 30, 30 a pivot hole 31 for insertion of a pintle 35 of the pull tab 4, and on its front and rear inner wall surfaces 32 front and rear vertical ledges 33, 33 to be fitted in the central groove 12 of the attaching lug 10 and the vertical groove 18 of the auxiliary lug 11, respectively. Further, the cover 3 has on the inner surface of its top wall a pair of spring-holding projections 34, 34; one of the spring-holding projections 34 is to be received in the central groove 12 of the attaching lug 10 while the other spring-holding projection 34 is to contact with the outer surface of the auxiliary lug 11. The confronting surfaces of the pair of spring-holding projections 34, 34 are inclined so as to contact with the actuation portion 29 of the leaf spring 2. Furthermore, the vertical ledges 33, 33 and the spring-holding projections 34, 34 of the cover 3 are arranged in symmetry with respect to the center of the length of the cover 3.

The pull tab 4 is a rectangular plate having at one end a grip 36 and at the other end a pintle 35 to be placed on the upper wing 5 of the slider body 1 between the attaching lug 10 and the guide projection 23, and between the slider body 1 and the actuation portion 29 of the locking leaf spring 2.

Preferably, the slider body 1, the cover 3 and the pull tab 4 are made of low-melting-point metal, such as aluminum alloy and zinc alloy, by die-casting.

For assembly, firstly the pintle 35 of the pull tab 4 is placed on the upper wing 5 of the slider body 1 between the attaching lug 10 and the guide projection 23, and then the locking leaf spring 2 is placed over the pintle 35. At the same time, the resilient portion 27 is received in the central groove 12 of the attaching lug 10 with the opposite side protuberances 28, 28 received in the respective transverse recesses 13, 13 of the attaching lug 10. And the actuation portion 29 extends over the pintle 35 and received in the cutout 25 of the guide projection 23, while the locking pawl 26 is inserted through the through-hole 22 of the upper wing 5.

Then, the cover 3 is mounted over the upper wing 5 of the slider body 1 in such a manner that, with the pivot holes 31, 31 facing the pintle 35, the front vertical ledge 33 is inserted in the central groove 12 of the attaching lug 10 while the rear vertical ledge 33 is inserted in the vertical groove 18 of the auxiliary lug 11. Also one spring-holding projection 34 is received in the central groove 12 so as to contact with the end of the resilient portion 27 while the other spring-holding projection 34 contact with the front surface of the auxiliary lug 11. Inside the cover 3, in the meantime, with the protuberances 28 pressed against the transverse recesses 13, 13 of the attaching lug 10, the opposite side walls 30, 30 of the cover 3 are clenched against the recesses 15, 20 so that the cover 3 is prevented from being removed off the slider body 1 by the stepped portions 16, 21, thus finalizing the assembling of the slider.

Figure 6:
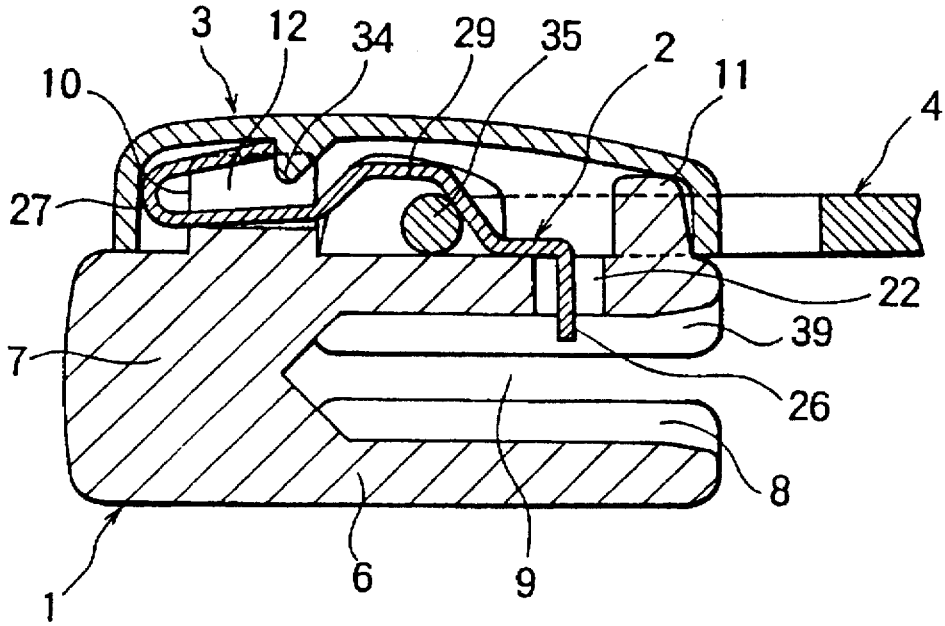
FIG. 6 is a longitudinal cross-sectional view of an automatic lock slider according to a second embodiment.
Figure 7:
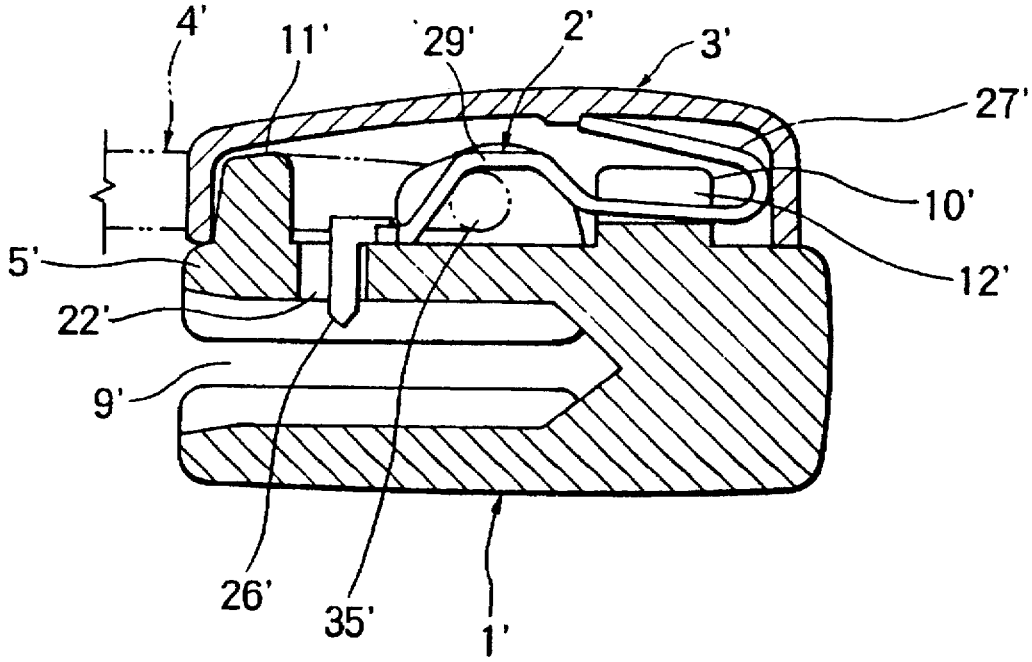
FIG. 7 (PRIOR ART)
FIG. 7 is a longitudinal cross-sectional view of a conventional automatic lock slider.

FIG. 6 shows a modified automatic lock slider according to a second embodiment, which is similar in structure to that of the first embodiment except that only a modified attaching lug 10 and a modified auxiliary lug 11 stand on the upper surface of the upper wing 5 of the slider body 1, namely, no guide projection exists. The modified attaching lug 10 has only a central groove 12 and a pair of opposite side recesses, namely, no transverse recesses exist, while the modified auxiliary lug 11 has only opposite side recesses. A modified locking leaf spring 2 has a U-shape resilient portion 27, which is elongated compared to that of the first embodiment and is devoid of opposite side protuberances. Further, the modified locking leaf spring 2 has an actuation portion 29, which has a trapezoidal profile in cross section unlike the first embodiment. A modified cover 3 has only a single spring-holding projection 34 to be received in the central groove 12 of the attaching lug 10; no vertical ledges are provided.

For assembling the modified slider, firstly the pintle 35 of the pull tab 4 is placed on the upper surface of the slider body 1 between the attaching lug 10 and the through-hole 22, and then the locking leaf spring 2 is placed over the pintle 35. At the same time, the resilient portion 27 is received in the central groove 12 of the attaching lug 10 with the actuation portion 29 extending over the pintle 35. Then the cover 3 is mounted over the upper wing 5 so as to cover the leaf spring 2 together with the two lugs 10, 11, at which time the spring-holding projection 34 is received in the central groove 12 of the attaching lug 10 to contact with the end of the resilient portion 27. Finally, opposite side walls of the cover 3 are clenched against the side recesses of the attaching and auxiliary lugs 10, 11.

Figure 5:
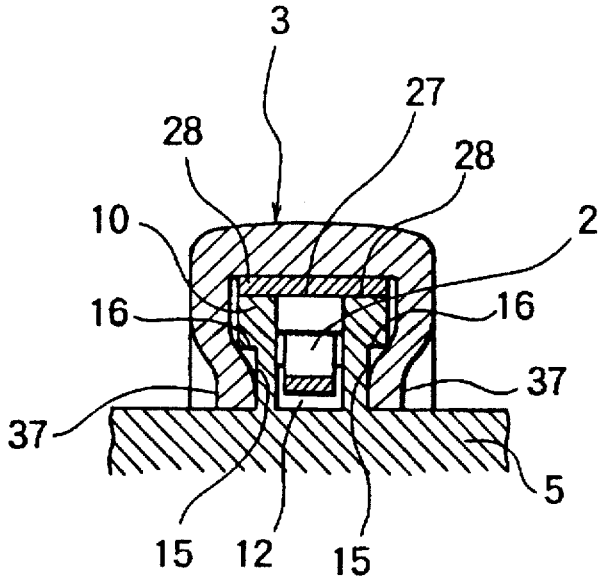
FIG. 5 is a cross-sectional view taken along line I—I of FIG. 2.

In FIG. 5, reference numeral 37 designates the portions in which the side walls 30, 30 of the cover 3 are clenched against the recesses 15, 20 of the attaching and auxiliary lugs 10, 11. In each clenched portion 37, the side wall 30 may be deformed into a hemisphere of may be cut and bent at its edge. 38 designates a ring of the pull tab 4. Further, in FIG. 6, 39 designates flanges bent and extending along opposite side edges of the upper wing 5.

The automatic lock slider for a slide fastener according to this invention has the following advantageous results:

According to structure of this invention, partly since the resilient portion 27 of the locking leaf spring 2 is completely received and protected in the central groove 12 of the attaching lug 10, and partly since the end of the resilient portion 27 is held by the attaching lug 10 and the cover 3, it is possible to attach the locking leaf spring 2 firmly. Further, since the spring-holding projection 34 is received in the central groove 12 of the attaching lug, it is possible to prevent the attaching lug 10 from falling flat inwardly when the cover 3 is clenched against the attaching lug 10, thus guaranteeing a smooth action of the resilient portion 27 in repeated use.

According to a specific feature of the invention, since each of the lugs 10, 11 has a pair of opposite side recesses 15, 15: 20, 20, each with a straight stepped portion 16, 21, against which recesses 15, 15: 20, 20 opposite side walls 30, 30 of the cover 3 is to be clenched, it is possible to attach the cover 3 to the lugs 10, 11 firmly as the straight stepped portions 16, 16: 21, 21 serve to effectively prevent the cover 3 from being removed off the slider body 1.

According to another specific feature of the invention, since the opposite side protuberances 28, 28 projecting from one end of the locking leaf spring 2 are received in the transverse recesses 13, 13 in the upper surface of the attaching lug 10 and pressed and held by the cover 3, it is possible to mount the locking leaf spring 2 on the slider body 1 firmly and accurately, thus guaranteeing an improved durability.

According to a further specific feature of the invention, since the cover 3 has on each of its front and rear inner wall surfaces a vertical ledge 33 to be fitted in the central groove 12 of the attaching lug 10 and the vertical groove 18 of the auxiliary lug 11, respectively, it is possible to attach the cover 3 to the slider body 1 more firmly and also to prevent the attaching lug 10 from falling flat inwardly when the cover 3 is clenched against the attaching lug 10.

According to an additional specific feature of the invention, partly since the pintle 35 of the pull tab 4 is placed between an inclined guide surface 17 of the attaching lug 10 and an inclined guide surface 24 of the guide projection 23, which stands in front of the locking-pawl-insertion through-hole 22, and partly since the actuation portion 29 of the locking leaf spring 2 is received in the cutout 25 of the guide projection 23, it is possible to guide the pintle 35 of the pull tab 4 smoothly during the pulling of the pull tab 4.

Further, according to another specific feature of the invention, partly since the opposite pivot holes 31, 31 of the cover 3 are formed centrally in the respective side walls 30, 30 and partly since the opposite spring-holding projections 34, 34 on the inner surface of the top wall of the cover 3 and the opposite vertical ledges 33, 33 on the inner surfaces of the cover 3 are arranged in symmetry longitudinally of the cover 3, it is possible to supply the individual covers 3 in either direction smoothly during the automatic assembling process of the sliders, thus causing easy assembling and an improved rate of production.

What is claimed is:

1. An automatic lock slider for a slide fastener, comprising:

(a) a slider body composed of upper and lower wings joined together at their front ends by a guide post so as to define between said upper and lower wings a fastener-element guide channel, said upper wing having a through-hole communicating with said fastener-element guide channel;

(b) a pull-tab attaching lug projecting on an upper surface of said upper wing and having a central groove;

(c) an S-shape leaf spring having at one end a resilient portion received in said central groove and at the other end a locking pawl urged to normally project into said fastener-element guide channel through said through-hole under a resilience of said leaf spring, said resilient portion having a free end extending towards a rear end of the slider body, said leaf spring further having an actuation portion extending between said resilient portion and said locking pawl;

(d) a pull tab having a pintle placed between said actuation portion of said leaf spring and said upper wing for actuating said actuation portion to retract said locking pawl from said fastener-element guide channel; and (e) a cover secured to said pull-tab attaching lug for covering said leaf spring, said cover having on its inner surface a spring-holding projecting fitted in said central groove of said pull-tab attaching lug so as to hold said one end of said leaf spring in said central groove.

2. An automatic lock slider according to claim 1, further comprising an auxiliary lug projecting on said upper surface of said upper wing at a rear end, said pull-tab attaching lug being situated at a front end of said upper wing, each of said lugs having a pair of opposite side recesses each defining a straight stepped portion, said cover having opposite side walls clenched against said opposite side recesses.

3. An automatic lock slider according to claim 2, wherein said pull-tab attaching lug has in its upper surface a pair of transverse recesses, said leaf spring having at said one end a pair of opposite side protuberances received in said transverse recesses and held by said cover.

4. An automatic lock slider according to claim 3, wherein said auxiliary lug has in its rear end surface a vertical groove, said cover having on each of front and rear inner wall surfaces thereof a vertical ledge fitted in said central groove of said pull-tab attaching lug and said vertical groove of said auxiliary lug, respectively.

5. An automatic lock slider according to claim 4, further comprising a guide projection standing from said upper surface of said upper wing between said pull-tab attaching lug and said through-hole and having on its front end an inclined guide surface, said pull-tab attaching lug having on its rear end an inclined guide surface confronting said guide surface of said guide projection, said guide projection having an upper central cutout for receiving said actuation portion of said leaf spring, said pintle of said pull tab being located between said guide surfaces of said attaching lug and said guide projection.

6. An automatic lock slider according to claim 5, wherein said cover having centrally in its opposite side walls a pair of pivot holes through which said pintle of said pull tab is inserted, said cover further having another spring-holding projection, said vertical ledges and spring-holding projections being arranged in symmetry longitudinally of said cover.

7. An automatic lock slider according to claim 4, wherein said cover having centrally in its opposite side walls a pair of pivot holes through which said pintle of said pull tab is inserted, said cover further having another spring-holding projections, said vertical ledges and spring-holding projections being arranged in symmetry longitudinally of said cover.

8. An automatic lock slider according to claim 3, further comprising a guide projection standing from said upper surface of said upper wing between said pull-tab attaching lug and said through-hole and having on its front end an inclined guide surface, said pull-tab attaching lug having on its rear end an inclined guide surface confronting said guide surface of said guide projection, said guide projection having an upper central cutout for receiving said actuation portion of said leaf spring, said pintle of said pull tab being located between said guide surfaces of said attaching lug and said guide projection.

9. An automatic lock slider according to claim 8, further comprising an auxiliary lug projecting on said upper surface of said upper wing at a rear end thereof, and said pull-tab attaching lug being situated at a front end of said upper wing, said auxiliary lug having at its rear end a vertical groove, wherein said cover having centrally in its opposite side walls a pair of pivot holes through which said pintle of said pull tab is inserted, said cover further having another spring-holding projection, and said cover having on each of front end rear inner wall surfaces thereof a vertical ledge, said vertical ledges fitting into said central groove of said pull tab attaching lug and said vertical groove of said auxiliary lug, respectively, said vertical ledges and spring-holding projections being arranged in symmetry longitudinally of said cover.

10. An automatic lock slider according to claim 2, wherein said auxiliary lug has in its rear end surface a vertical groove, said cover having on each of front and rear inner wall surfaces thereof a vertical ledge fitted in said central groove of said pull-tab attaching lug and said vertical groove of said auxiliary lug, respectively.

11. An automatic lock slider according to claim 10, further comprising a guide projection standing from said upper surface of said upper wing between said pull-tab attaching lug and said through-hole and having on its front end an inclined guide surface, said pull-tab attaching lug having on its rear end an inclined guide surface confronting said guide surface of said guide projection, said guide projection having an upper central cutout for receiving said actuation portion of said leaf spring, said pintle of said pull tab being located between said guide surfaces of said attaching lug and said guide projection.

12. An automatic lock slider according to claim 11, wherein said cover having centrally in its opposite side walls a pair of pivot holes through which said pintle of said pull tab is inserted, said cover further having another spring-holding projection, said vertical ledges and spring-holding projections being arranged in symmetry longitudinally of said cover.

13. An automatic lock slider according to claim 10, wherein said cover having centrally in its opposite side walls a pair of pivot holes through which said pintle of said pull tab is inserted, said cover further having another spring-holding projection, said vertical ledges and spring-holding projections being arranged in symmetry longitudinally of said cover.

14. An automatic lock slider according to claim 2, further comprising a guide projection standing from said upper surface of said upper wing between said pull-tab attaching lug and said through-hole and having on its front end an inclined guide surface, said pull-tab attaching lug having on its rear end an inclined guide surface confronting said guide surface of said guide projection, said guide projection having an upper central cutout for receiving said actuation portion of said leaf spring, said pintle of said pull tab being located between said guide surfaces of said attaching lug and said guide projection.

15. An automatic lock slider according to claim 14, further comprising an auxiliary lug projecting on said upper surface of said upper wing at a rear end thereof, and said pull-tab attaching lug being situated at a front end of said upper wing, said auxiliary lug having at its rear end a vertical groove, wherein said cover having centrally in its opposite side walls a pair of pivot holes thorough which said pintle of said pull tab is inserted, said cover further having another spring-holding projection, and said cover having on each of front end rear inner wall surfaces thereof a vertical ledge, said vertical ledges fitting into said central groove of said pull tab attaching lug and said vertical groove of said auxiliary lug, respectively, said vertical ledges and spring-holding projections being arranged in symmetry longitudinally of said cover.

16. An automatic lock slider according to claim 1, wherein said pull-tab attaching lug has in its upper surface a pair of transverse recesses, said leaf spring having at said one end a pair of opposite side protuberances received in said transverse recesses and held by said cover.

17. An automatic lock slider according to claim 16, further comprising an auxiliary lug, wherein said auxiliary lug has in its rear end surface a vertical groove, said cover having on each of front and rear inner wall surfaces thereof a vertical ledge fitted in said central groove of said pull-tab attaching lug and said vertical groove of said auxiliary lug, respectively.

18. An automatic lock slider according to claim 17, further comprising a guide projection standing from said upper surface of said upper wing between said pull-tab attaching lug and said through-hole and having on its front end an inclined guide surface, said pull-tab attaching lug having on its rear end an inclined guide surface confronting said guide surface of said guide projection, said guide projection having an upper central cutout for receiving said actuation portion of said leaf spring, said pintle of said pull tab being located between said guide surfaces of said attaching lug and said guide projection.

19. An automatic lock slider according to claim 18, wherein said cover having centrally in its opposite side walls a pair of pivot holes through which said pintle of said pull tab is inserted, said cover further having another spring-holding projection, said vertical ledges and spring-holding projections being arranged in symmetry longitudinally of said cover.

20. An automatic lock slider according to claim 17, wherein said cover having centrally in its opposite side walls a pair of pivot holes through which said pintle of said pull tab is inserted, said cover further having another spring-holding projection, said vertical ledges and spring-holding projections being arranged in symmetry longitudinally of said cover.

21. An automatic lock slider according to claim 16, further comprising a guide projection standing from said upper surface of said upper wing between said pull-tab attaching lug and said through-hole and having on its front end an inclined guide surface, said pull-tab attaching lug having on its rear end an inclined guide surface confronting said guide surface of said guide projection, said guide projection having an upper central cutout for receiving said actuation portion of said leaf spring, said pintle of said pull tab being located between said guide surfaces of said attaching lug and said guide projection.

22. An automatic lock slider according to claim 21, further comprising an auxiliary lug projecting on said upper surface of said upper wing at a rear end thereof, and said pull-tab attaching lug being situated at a front end of said upper wing, said auxiliary lug having at its rear end a vertical groove, wherein said cover having centrally in its opposite side walls a pair of pivot holes through which said pintle of said pull tab is inserted, said cover further having another spring-holding projection, and said cover having on each of front end rear inner wall surfaces thereof a vertical ledge, said vertical ledges fitting into said central groove of said pull tab attaching lug and said vertical groove of said auxiliary lug, respectively, said vertical ledges and spring-holding projections being arranged in symmetry longitudinally of said cover.

23. An automatic lock slider according to claim 1, further comprising a guide projection standing from said upper surface of said upper wing between said pull-tab attaching lug and said through-hole and having on its front end an inclined guide surface, said pull-tab attaching lug having on its rear end an inclined guide surface confronting said guide surface of said guide projection, said guide projection having an upper central cutout for receiving said actuation portion of said leaf spring, said pintle of said pull tab being located between said guide surfaces of said attaching lug and said guide projection.

24. An automatic lock slider according to claim 23, further comprising an auxiliary lug projecting on said upper surface of said upper wing at a rear end thereof, and said pull-tab attaching lug being situated at a front end of said upper wing, said auxiliary lug having at its rear end a vertical groove, wherein said cover having centrally in its opposite side walls a pair of pivot holes through which said pintle of said pull tab is inserted, said cover further having another spring-holding projection, and said cover having on each of front end rear inner wall surfaces thereof a vertical ledge, said vertical ledges fitting into said central groove of said pull tab attaching lug and said vertical groove of said auxiliary lug, respectively, said vertical ledges and spring-holding projections being arranged in symmetry longitudinally of said cover.

* * * * *